US011532314B2

(12) United States Patent
Alakuijala et al.

(10) Patent No.: US 11,532,314 B2
(45) Date of Patent: Dec. 20, 2022

(54) AMPLITUDE-INDEPENDENT WINDOW SIZES IN AUDIO ENCODING

(71) Applicant: GOOGLE LLC, Mountain View, CA (US)

(72) Inventors: Jyrki Antero Alakuijala, Wollerau (CH); Martin Bruse, Zurich (CH)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/733,656

(22) PCT Filed: Dec. 16, 2019

(86) PCT No.: PCT/US2019/066570

§ 371 (c)(1),
(2) Date: Sep. 24, 2020

(87) PCT Pub. No.: WO2021/126155

PCT Pub. Date: Jun. 24, 2021

(65) Prior Publication Data

US 2021/0233546 A1 Jul. 29, 2021

(51) Int. Cl.
*G10L 19/02* (2013.01)
*G10L 25/51* (2013.01)

(52) U.S. Cl.
CPC ..... *G10L 19/0212* (2013.01); *G10L 25/51* (2013.01)

(58) Field of Classification Search
CPC ..... G10L 19/0212; G10L 25/51
See application file for complete search history.

(56) References Cited

U.S. PATENT DOCUMENTS

2005/0129109 A1* 6/2005 Kim ..... G10H 1/0058 375/240.01
2014/0297271 A1* 10/2014 Geiser ..... G10L 19/02 704/207
2015/0276840 A1* 10/2015 Hejase ..... G01R 31/001 324/613
2015/0304766 A1* 10/2015 Delikaris-Manias ..... G10L 21/0216 381/92
2017/0162209 A1* 6/2017 Spanias ..... G10L 25/48
2018/0190303 A1 7/2018 Ghido et al.
(Continued)

OTHER PUBLICATIONS

Bell, J. A. (2005). The underwater piano: a resonance theory of cochlear mechanics.*

(Continued)

*Primary Examiner* — Bryan S Blankenagel
(74) *Attorney, Agent, or Firm* — Brake Hughes Bellermann LLP

(57) ABSTRACT

A computer-implemented method can include receiving a first signal corresponding to a first flow of acoustic energy, applying a transform to the received first signal using at least a first amplitude-independent window size at a first frequency and a second amplitude-independent window size at a second frequency, the second amplitude-independent window size improving a temporal response at the second frequency, wherein the second frequency is subject to amplitude reduction due to a resonance phenomenon associated with the first frequency, and storing a first encoded signal, the first encoded signal based on applying the transform to the received first signal.

27 Claims, 7 Drawing Sheets

(56) References Cited

U.S. PATENT DOCUMENTS

2019/0074805 A1 3/2019 Hatab et al.
2019/0318733 A1* 10/2019 Mani ..... G10L 21/0208

OTHER PUBLICATIONS

Baltus, A., & Herrmann, C. S. (2015). Auditory temporal resolution is linked to resonance frequency of the auditory cortex. International Journal of Psychophysiology, 98(1), 1-7.*
International Search Report and Written Opinion for PCT Application No. PCT/US2019/066570, dated Jul. 6, 2020, 12 pages.
Anderson, David V., "Speech Analysis and Coding Using a Multi-Resolution Sinusoidal Transform", Conference Proceedings/The 1996 IEEE International Conference on Acoustics, Speech, and Signal Processing, IEEE Service Center,, May 7, 1996, 5 pages.
Levine, Scott Nathan, "Audio Representations for Data Compression and Compressed Domain Processing", Retrieved from the Internet: URL:http://citeseerx.ist.psu.edu/viewdoc/download?doi=10.1.1.8.6529&rep=rep1&type=pdf, Dec. 1998, 147 pages.

* cited by examiner

AMPLITUDE-INDEPENDENT WINDOW SIZES IN AUDIO ENCODING

CROSS REFERENCE TO RELATED APPLICATION

This application is a 35 U.S.C. § 371 National Phase Entry Application from PCT/US2019/066570 filed Dec. 16, 2019, designating the U.S., the disclosure of which is incorporated herein by reference in its entirety.

TECHNICAL FIELD

This document relates, generally, to amplitude-independent window sizes in audio encoding.

BACKGROUND

Audio processing remains an important aspect of today's technology environment. Digital assistants used in personal and professional situations to aid users in performing various tasks are trained to recognize speech to detect their cues and instructions. Speech recognition is also used to create a digitally accessible record of events where people are talking. In the rapidly growing world of virtual reality and/or augmented reality, audio processing provides the user a plausible auditory experience in order to best perceive and interact with a digital environment.

SUMMARY

In an aspect of the present disclosure, there is provided a computer-implemented method. The method comprises receiving a first signal corresponding to a first flow of acoustic energy, applying a transform to the received first signal using at least a first amplitude-independent window size at a first frequency and a second amplitude-independent window size at a second frequency, the second amplitude-independent window size improving a temporal response at the second frequency, wherein the second frequency is subject to amplitude reduction due to a resonance phenomenon associated with the first frequency, and storing a first encoded signal, the first encoded signal based on applying the transform to the received first signal.

For example, the first frequency may be about 3 kHz, and the second frequency may be about 1.5 kHz or about 10 kHz. The first amplitude-independent window size may be about 18-30 ms (e.g., about 24 ms). The second amplitude-independent window size may be about 3-9 ms (e.g., about 6 ms).

The method may further comprise mapping the first amplitude-independent window size to the first frequency based on the first frequency being associated with energy integration in human hearing.

The method may further comprise mapping the second amplitude-independent window size to the second frequency based on the second frequency being associated with energy differentiation in the human hearing.

The first amplitude-independent window size may be applied for all frequencies of the received first signal except a band at the second frequency. The first amplitude-independent window size may be greater than the second amplitude-independent window size. The first amplitude-independent window size may be greater than the second amplitude-independent window size by an integer multiple. The first amplitude-independent window size may be about four times greater than the second amplitude-independent window size.

The method may further comprise using a third amplitude-independent window size in applying the transform to the first received signal, the third amplitude-independent window size used at a third frequency not associated with the resonance phenomenon, the third amplitude-independent window size different from the first and second amplitude-independent window sizes.

The third amplitude-independent window size may be smaller than the first amplitude-independent window size. The third amplitude-independent window size may be about half as large as the first amplitude-independent window size. The third amplitude-independent window size may be greater than the second amplitude-independent window size. The third amplitude-independent window size may be about twice as large as the second amplitude-independent window size. The third amplitude-independent window size may be smaller than the first amplitude-independent window size.

Applying the transform using the first amplitude-independent window size at the first frequency may generate a first outcome, wherein applying the transform using the second amplitude-independent window size at the second frequency may generate a second outcome, the method further comprising storing the second outcome more frequently than storing the first outcome.

The method may further comprise storing the second outcome with less precision than the first outcome.

The method may further comprise using a third amplitude-independent window size in applying the transform at a third frequency, the third amplitude-independent window size improving a temporal response at the third frequency, the third frequency subject to amplitude reduction due to the resonance phenomenon associated with the first frequency.

The second and third frequencies may be positioned at opposite sides of the first frequency.

The third amplitude-independent window size may be about equal to the second amplitude-independent window size.

The second and third amplitude-independent window sizes may be smaller than the first amplitude-independent window size.

The first audio file may comprise the first encoded signal, and the method may further comprise receiving a second signal corresponding to a second flow of acoustic energy, applying the transform to the received second signal using at least the first amplitude-independent window size at the first frequency and the second amplitude-independent window size at the second frequency, storing a second encoded signal, the second encoded signal based on applying the transform to the received second signal, wherein a second audio file comprises the second encoded signal, and determining a difference between the first and second audio files.

Determining the difference may comprise playing the first and second audio files into a model of human hearing, the model including the resonance phenomenon.

In an aspect of the present disclosure there is provided a computer program product tangibly embodied in a non-transitory storage medium, the computer program product including instructions that when executed by a processor cause the processor to perform operations of any of the method steps described herein.

Optional features of one aspect may be combined with any other aspect.

BRIEF DESCRIPTION OF DRAWINGS

Like reference symbols in the various drawings indicate like elements.

DETAILED DESCRIPTION

This document describes examples of audio processing using amplitude-independent window sizes. In some implementations, a relatively larger window size can be used in processing signals having a frequency that is associated with a resonance phenomenon in human ears. For example, the window size can be about two times as large as a window size used for another frequency. In some implementations, a relatively smaller window size can be used in processing signals having a frequency that is subject to amplitude reduction due to the resonance phenomenon. For example, the window size can be about two times smaller than a window size used for another frequency.

Figure 1:
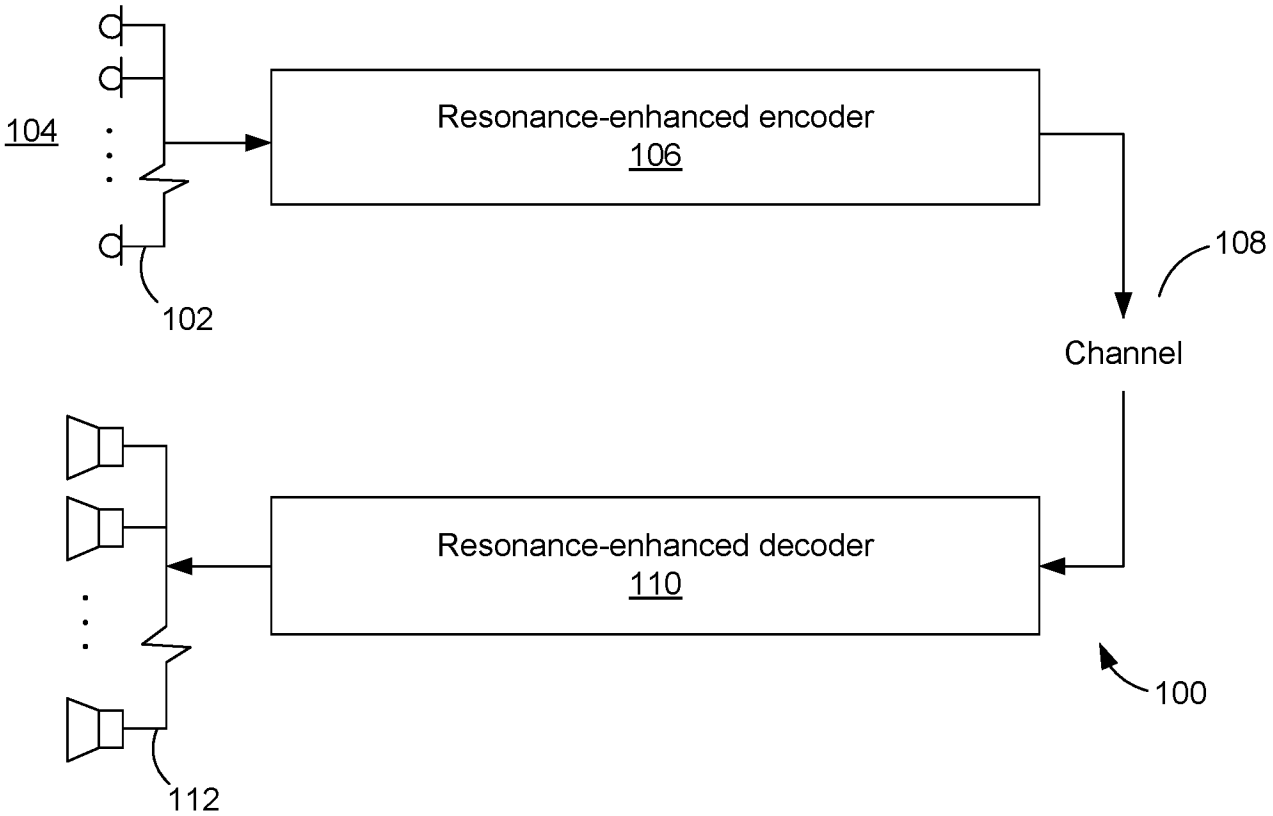
FIG. 1 shows an example of a system.

FIG. 1 shows an example of a system 100. The system 100 can be used with one or more other examples described elsewhere herein. The system 100 includes multiple sound sensors 102, including, but not limited to, microphones. For example, one or more omnidirectional microphones and/or microphones of other spatial characteristics can be used. The sound sensors 102 detect audio in a space 104. For example, the space 104 can be characterized by structures (such as in a recording studio with a particular ambient impulse response) or it can be characterized as being essentially free of surrounding structures (such as in a substantially open space). The output of the sound sensors can be provided to a resonance-enhanced encoder 106. The resonance-enhanced encoder 106 can perform improved encoding of audio signals from the sound sensors 102. In some implementations, the resonance-enhanced encoder 106 can improve the temporal response at one or more specific frequencies of the sound signal that are associated with a resonance phenomenon. A temporal response can be improved by increasing the temporal resolution of the encoding process at one or more frequencies. For example, the temporal resolution can be increased by including relatively less audio content (e.g., a temporally shorter portion of a signal) when applying a transform. Such an approach can improve the ability of the system 100 (or another component, including, but not limited to, an audio analyzer) to determine directionality of sound; that is, to distinguish two or more sound sources from each other based at least in part on their spatiality.

Prior to the resonance-enhanced encoder 106 encoding the signal from the sound sensors 102, one or more types of conditioning of the signal can be performed. In some implementations, the signal can be processed to generate a particular representation (e.g., according to a prespecified format). For example, the representation can be decomposed into respective channels of the sound from the sound sensors 102.

In the encoding, the resonance-enhanced encoder 106 can apply a transformation to the signal from the sound sensors 102. The transformation can involve applying two or more different window sizes to respective frequencies (or frequency bands) of the signal from the sound sensors 102. In some implementations, a window size is amplitude-independent, meaning that the window size is applied to the specific at least one frequency (band) regardless of the nature of that aspect of the signal. For example, the resonance-enhanced encoder 106 may not take into account whether the frequency (band) contains sustained levels of acoustic energy, and/or whether the frequency (band) contains any transients, such as a region of relatively short duration having a higher amplitude than surrounding portions of a waveform. The use of different window sizes can help address circumstances related to listening, including, but not limited to, acoustic characteristics such as resonance phenomena.

After encoding, the encoded signal can be stored, forwarded and/or transmitted to another location. For example, a channel 108 represents one or more ways that an encoded audio signal can be managed, such as by transmission to another system for playback.

If the audio of the encoded signal should be played, a decoding process can be performed. Such a decoding process can be performed by a resonance-enhanced decoder 110. For example, the resonance-enhanced decoder 110 can perform operations in essentially the opposite way as in the resonance-enhanced encoder 106. For example, an inverse transform can be performed in the decoding module that partially or completely restores a particular representation that was generated by the resonance-enhanced encoder 106. The resulting audio signals can be stored and/or played depending on the situation. For example, the system 100 can include two or more audio playback sources 112 (including, but not limited to, loudspeakers) to which the processed audio signal can be provided for playback.

The representation of signal from the sound sensors 102 can be played out over headphones, and the system 100 can compute what should be rendered in the headphones. In some implementations, this can be applied in situations involving virtual reality (VR) and/or augmented reality (AR). In some implementations, the rendering can be dependent how the user turns his or her head. For example, a sensor can be used that informs the system of the head orientation, and the system can then cause the person to hear the sound coming from a direction that is independent of the head orientation. As another example, the representation of signal from the sound sensors 102 can be played out over a set of loudspeakers. That is, first the system 100 can store or transmit the description of the field of sound around the listener. At the resonance-enhanced decoder 110, a computation can then be made what the individual speakers should produce to create the field of sound around the listener's head. That is, approaches exemplified herein can facilitate improved spatial decomposition of sound.

Figure 2:
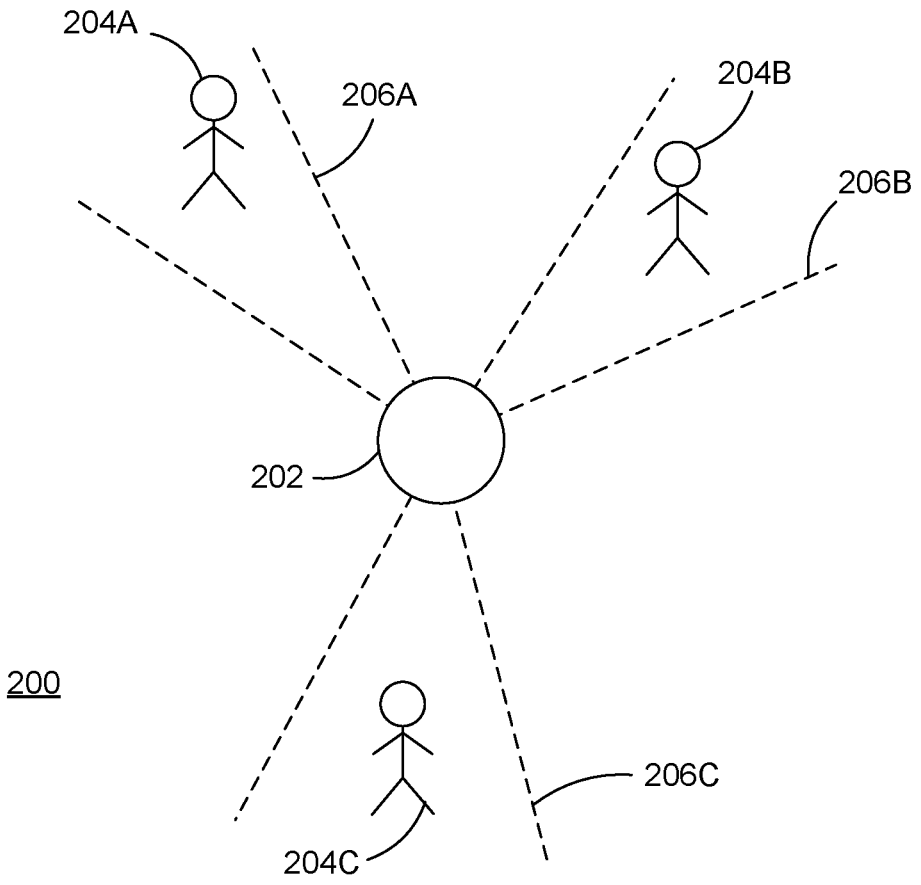
FIG. 2 shows an example of determining directionality of sound sources.

FIG. 2 shows an example of determining directionality of sound sources. Here, examples of spatial profiles are schematically shown. A physical space 200 can include any spatial expanse, including, but not limited to, a room, an outdoors area or a region of the atmosphere. A circle 202 schematically represents a listener in each situation. For the purpose of the present examples, the listener represented by the circle 202 can be either an apparatus according to the present subject matter (e.g., the system 100 in FIG. 1), or a human listener. The listener will perceive sound that is represented as a flow of acoustic energy. For example, an apparatus can perceive sound for purposes of encoding it (e.g., the apparatus can be an encoder according to the present subject matter). As another example, an apparatus can perceive sound for purposes of analyzing it, such as to make a difference determination (e.g., the apparatus can be an audio analyzer according to the present subject matter). As another example, the human listener can perceive sounds in the physical space 200 by being an active or passive listener in or near that space.

People 204A-C are schematically illustrated as being in the physical space 200. The people symbols represent sources of any kind of sounds that the listener can hear. Such sounds can be generated by humans (e.g., speech, song or other utterances), by nature (e.g., wind, animals, or other natural phenomena), or by technology (e.g., machines, loudspeakers, or other human-made apparatuses). That is, the present subject matter relates to sound from one or more types of sources, whether the sounds are caused by humans or not. The locations of the people 204A-C around the circle 202 indicate that the circle 202 can perceive sounds from multiple separate directions. Here, each of the people 204A-C can be said to have associated with them a corresponding spatial profile 206A-C. The spatial profiles 206A-C signify the direction from which the listener can perceive the sound arriving. The spatial profiles 206A-C correspond to how the sound from different sound sources is captured: some of it arrives directly from the sound source, and other sound (generated simultaneously) first bounces on one or more surfaces before being perceived. That is, the sound(s) here represented by the person 204A can have the spatial profile 206A, the sound(s) here represented by the person 204B can have the spatial profile 206B, and the sound(s) here represented by the person 204C can have the spatial profile 206C.

In the context of a room, the notion of a spatial profile is a generalization of this illustrative example. There, the spatial profile includes both the direct path and all the reflective paths through which the sound of the source travels to reach the listener of the circle 202. In a different situation, such as when the physical space 200 is relatively free from structure or inhibits echoes and other acoustic reflections), the direct path of the acoustic energy can predominate at the circle 202. In some implementations, the term "direction" can be taken as having a generalized meaning and to be equivalent to a set of directions representing the direct path and all reflective paths. More or fewer spatial profiles than the spatial profiles 206A-C can occur in some implementations.

Different listeners represented by the circle 202 can have different ability to spatially resolve the sound arriving that has the respective spatial profiles 206A-C. A human, for example, may be able to identify ten, perhaps fifteen, sound sources in parallel based on their respective spatial profiles 206A-C. An apparatus, on the other hand (e.g., a computer-based system prior to the present subject matter), may be able to distinguish significantly fewer sound sources in parallel than the human listener. For example, prior computers have been able to distinguish fewer than three simultaneous sound sources in parallel (e.g., about two sound sources). This can give rise to limitations in the ability of audio equipment to perform spatial decomposition (e.g., in an AR/VR system). As such, using a computer-based system with an improved ability for spatial decomposition can allow the listener of the circle 202 to distinguish between more of the spatial profiles 206A-C.

Determining directionality of sound may be dependent on multiple factors, including, but not limited to, a temporal response. In some implementations, temporal response can signify a system's ability to temporally detect the beginning or ending of an acoustic phenomenon. For example, an improved temporal response corresponds to the system being better at pinpointing when a sound begins or ends. This applies to any kinds of sounds, both sustained levels of acoustic energy and transients.

Figure 3:
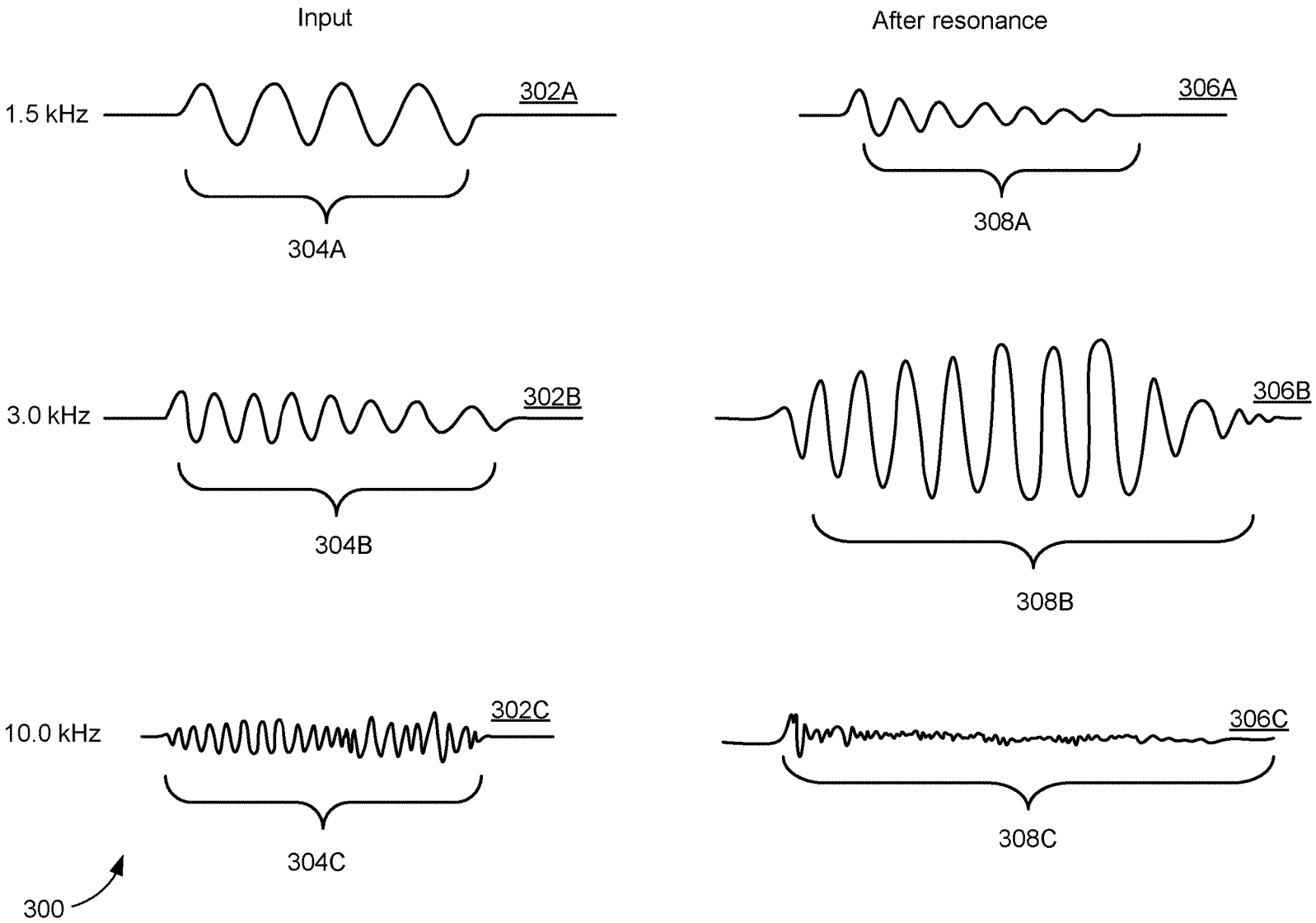
FIG. 3 shows examples of audio signals.

FIG. 3 shows examples of audio signals 300. The audio signals 300 can occur in, or be taken into account in, one or more other examples described elsewhere herein. The audio signals 300 here include input signals 302A-C that can be referred to respective inputs to some system. That is, each of the input signals 302A-C represents an audio signal (e.g., a flow of acoustic energy) that can be registered by a computer system and/or a human listener. Some examples described with reference to the signals 300 will be based on a human listener. The input signals 302A-C have different frequencies (or frequency bands). In some implementations, the input signal 302A is associated with a frequency of about 1.5 kHz. For example, this corresponds to a period of about 666 microseconds (μs). In some implementations, the input signal 302B is associated with a frequency of about 3.0 kHz. For example, this corresponds to a period of about 333 μs. In some implementations, the input signal 302C is associated with a frequency of about 10.0 kHz. For example, this corresponds to a period of about 100 μs. The input signals 302A-C can be separate and independent from each other, or they can be part of the same acoustic signal. For example, an array of band-pass filters can be used to separate an input signal into multiple components, including, but not limited to, the input signals 302A-C.

Each of the input signals 302A-C can include any kinds of audio signal content. In some implementations, the input signal 302A includes a waveform 304A. For example, the waveform 304A can be a relatively homogeneous group of waves that have similar or identical amplitude and have a frequency of about 1.5 kHz. In some implementations, the input signal 302B includes a waveform 304B. For example, the waveform 304B can be a relatively homogeneous group of waves that have similar or identical amplitude and have a frequency of about 3.0 kHz. In some implementations, the input signal 302C includes a waveform 304C. For example, the waveform 304C can be a relatively homogeneous group of waves that have similar or identical amplitude and have a frequency of about 10.0 kHz.

One or more acoustic phenomena can affect the perception of the input signals 302A-C. In some implementations, resonance can occur. For example, the human ear has a resonance at about 3 kHz that can be explained by elasto-viscous properties of a membrane that is oscillating in the ear, and the interaction of hair cells on that membrane. This resonance phenomenon is common among all humans. The resonance can have certain impacts on how the human ear receives sound waves.

Beginning with the input signal 302B, this signal is at about the resonance frequency 3.0 kHz and therefore the ear will receive a signal 306B that is affected by resonance. The resonance can cause an amplification of the input signal 302B. If the input signal 302B has a certain amplitude then the signal 306B can have an amplitude that is multiple times greater. For example, the amplitude of the signal 306B can be about double (e.g., an amplification by about +6 dB) the amplitude of the input signal 302B. The resonance can also cause a smearing of the time localization of transients at about the 3.0 kHz frequency. That is, the accumulation of energy associated with the resonance can integrate the signal energy over time. As such, the frequency 3.0 kHz can be associated with energy integration in human hearing. For example, this can blur the temporal characteristics of the transient and attenuate the transient (e.g., an attenuation by about a factor 2). This blurring can make the transient more difficult to detect (e.g., the transient can be said to disappear). This can cause the transient sound to be heard for longer than it occurred (e.g., the transient can be smeared forward in time). For example, the signal 306B can include a waveform 308B that is multiple times longer (e.g., three times longer) than the waveform 304B.

Turning now to the input signals 302A and 302C, these signals are at about two frequencies (1.5 kHz and 10.0 kHz, respectively) that are also affected by the resonance in the human ear, and therefore the ear will receive signals 306A and 306C, respectively, that are also affected by the resonance. Particularly, the resonance can cause a reduction in the input signals 302A and 302C. If the input signal 302A has a certain amplitude then the signal 306A can have an amplitude that is multiple times smaller. For example, the amplitude of the signal 306A can be about half (e.g., a reduction by about −6 dB) of the amplitude of the input signal 302A. If the input signal 302C has a certain amplitude then the signal 306C can have an amplitude that is multiple times smaller. For example, the amplitude of the signal 306C can be about half (e.g., a reduction by about −6 dB) of the amplitude of the input signal 302C. A transient at about 1.5 and/or 10.0 kHz can become more temporally localized (e.g., sharpened in time). For example, the resonance at 3.0 kHz can work as a derivative filter by cancelling surrounding frequencies, making transients in these frequencies enhanced, but dampening the energy in sustained waves. This can allow for more quantization, but leaves less room for placing the transient. For example, the signal 306A can include a waveform 308A that is multiple times shorter (e.g., three times shorter) than the waveform 304A. As another example, the signal 306C can include a waveform 308C that is multiple times shorter (e.g., three times shorter) than the waveform 304C. As such, each of the frequencies 1.5 and 10.0 kHz can be associated with energy differentiation in human hearing.

Applying aspects of the present subject matter can facilitate improved audio processing. For example, an audio compressor (e.g., as part of the resonance-enhanced encoder 106 in FIG. 1) and/or a component that evaluates audio signal similarity (e.g., the audio analyzer 700 in FIG. 7) can obtain increased amplitude sensitivity and/or increased temporal sensitivity. The present subject matter can be practiced by way of instructions (e.g., a computer program) stored in a computer program product and executable by at least one processor. In some implementations, performing operations according to the instructions can cause an increase in amplitude sensitivity at a first frequency (e.g., at about 3.0 kHz). For example, the increase in amplitude sensitivity can be due to using a larger amplitude-independent window size (e.g., a 2× larger window) at the first frequency than at another frequency (e.g., frequencies below about 1 kHz). In some implementations, performing operations according to the instructions can cause an increase in temporal sensitivity at a second frequency (e.g., at about 1.5 and/or about 10 kHz). For example, the increase in temporal sensitivity can be due to using a smaller amplitude-independent window size (e.g., a 2× smaller window) at the second frequency than at another frequency (e.g., frequencies below about 1 kHz).

Figure 4:
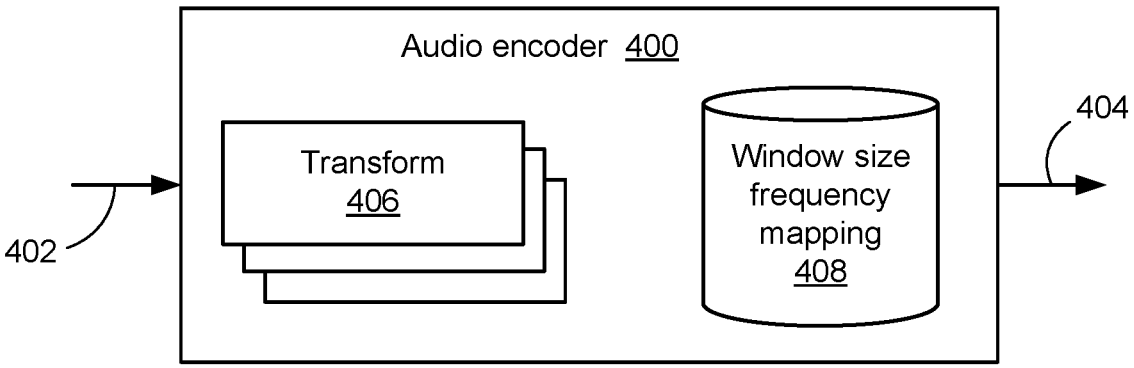
FIG. 4 shows an example of an audio encoder.

FIG. 4 shows an example of an audio encoder 400. The audio encoder 400 can be used with one or more examples described elsewhere herein. The audio encoder 400 is configured to receive an input 402 (e.g., one or more signals corresponding to a flow of acoustic energy), process the signal(s) of the input 402, and generate an output 404 (e.g., one or more encoded signals). In some implementations, the audio encoder 400 can be used with high-quality audio (e.g., to provide a high-quality hifi sound system). For example, the audio encoder 400 can support compression that is lossless (e.g., the original signal can be perfectly reconstructed using the encoded signal) or near lossless (e.g., the original signal can be almost perfectly reconstructed using the encoded signal). The audio encoder 400 can be implemented based on one or more examples described with reference to FIG. 9.

The audio encoder 400 can include one or more transforms 406. The transform(s) 406 can convert an audio signal from a temporal domain to a frequency domain. The transform 406 can be performed on one or more ranges of time, sometimes referred to as the window(s) used for the transform 406. When sounds are developing slowly, it can be said that the larger the window (e.g., the greater the number of milliseconds (ms) transformed), the more that portion of the signal can be compressed. With sounds, they can sometimes be assumed to develop relatively slowly at a relevant frame of reference. For example, with speech the audio signal is produced by a column of air that is vibrating, such that at some given time the air will vibrate at least substantially as it was, say, 20 ms earlier. In this context, an integral transform can be used to obtain predictive characteristics of the vibration. Any transform relating to frequencies can be used, including, but not limited to, a Fourier transform or a cosine transform. In some implementations, the discrete variation of a transform can be used. For example, the discrete Fourier transform (DFT) can be implemented as the fast Fourier transform (FFT). As another example, the discrete cosine transform (DCT) can be used.

The audio encoder 400 includes a mapping 408 between window size and frequency. The mapping 408 can be based on a resonance phenomenon in the human ear. In some implementations, the mapping 408 can associate a first window size with a frequency that is associated with energy integration in human hearing. For example, the frequency can be about 3.0 kHz (e.g., with a window size of about 18-30 ms, such as about 24 ms). In some implementations, the mapping 408 can associate a second window size with a frequency that is associated with energy differentiation in human hearing. For example, the frequency can be about 1.5 kHz and/or about 10.0 kHz (e.g., with a window size of about 3-9 ms, such as about 6 ms). In some implementations, the mapping 408 can associate a third window size with a frequency that is not associated with any particular acoustic phenomenon in human hearing (e.g., not associated with any resonance). For example, the frequency can be lower than about 1.0 kHz and/or greater than about 10.0 kHz (e.g., with a window size of about 6-18 ms, such as about 12 ms). The mapping 408 can effectuate associations between window sizes (e.g., in terms of size, such as ms) and frequency (e.g., in terms of one or more bands of frequencies) in any of multiple different ways. For example, the mapping 408 can include a lookup table to be used with one or more of the transforms 406. As another example, the mapping 408 can be integrated into one or more of the transforms 406 so as to automatically be applied to the transformation(s).

The encoder 400 is an example of an apparatus than can perform a method relating to improved coding. The method can include receiving a first signal (e.g., the signal 302B in FIG. 3) corresponding to a first flow of acoustic energy. The method can include applying a transform (e.g., FFT or DCT) to the received first signal. The transform can use at least a first amplitude-independent window size (e.g., about 24 ms)

at a first frequency (e.g., about 3 kHz) and a second amplitude-independent window size (e.g., about 6 ms) at a second frequency (e.g., about 1.5 kHz and/or about 10 kHz). The second amplitude-independent window size can improve a temporal response at the second frequency (e.g., the waveform 308A and/or 308C in FIG. 3 can represent a transient that is relatively more easy to detect). For example, the second amplitude-independent window size can improve the temporal response by being shorter than a window size used for the majority of the bandwidth, resulting in the transform being applied to a shorter span of audio signal each time. The second frequency can be subject to amplitude reduction (e.g., the signal 306A or 306C can have reduced amplitude relative to the input signal 302A or 302C, respectively) due to a resonance phenomenon associated with the first frequency. The method can include storing a first encoded signal (e.g., the output 404), the first encoded signal based on applying the transform to the received first signal.

Figure 5:
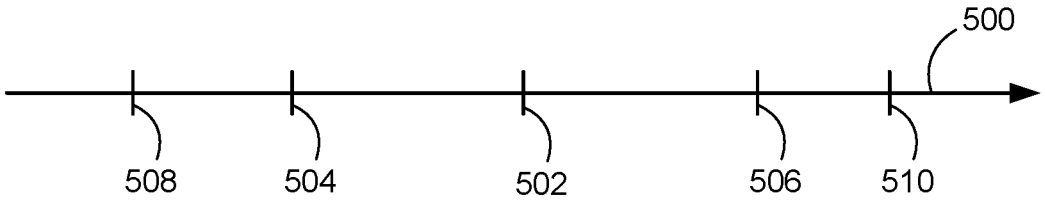
FIG. 5 shows examples of window sizes.

FIG. 5 shows examples of window sizes. The window sizes are shown relative to an axis 500 representing frequency. For example, the frequencies of the axis 500 are the respective frequencies that are included in an audio signal (e.g., as separated by a filter bank). A frequency 502 can be associated with a resonance phenomenon (e.g., in the human ear). For example, the resonance can amplify the signal at the frequency 502 and attenuate the signal at one or more other frequencies. Here, a frequency 504 and a frequency 506 are indicated. The frequency 504 and/or 506 can be associated with a resonance phenomenon (e.g., in the human ear). For example, the resonance can attenuate the signal at the frequency 504 and/or 506. In a transform, different window sizes can be used for one or more of the frequencies 502, 504, or 506, and the window sizes can be independent of the particular amplitude at any frequency (e.g., not dependent on whether a transient has been detected in the frequency (band)). In some implementations, the window size associated with the frequency 502 can be used for all frequencies of the signal except the frequency 504 and/or 506 (e.g., for one or more frequency band including the frequency 504 and/or 506). The frequencies 504 and 506 can use the same, or different, window size as each other. The window size of the frequency 502 can be greater than the window size of the frequency 504 and/or 506. Having the window size of the frequency 502 be greater than the window size of the frequency 504 and/or 506 can provide the advantage of more efficiently processing the portions of the audio signal where increased temporal response is relatively less significant (e.g., so that the transform is applied to a greater span of audio signal each time). For example, a 24 ms window is greater than a 6 ms window. In some implementations, the window size of the frequency 502 can be greater than the window size of the frequency 504 and/or 506 by an integer multiple. For example, a window size of about 24 ms is about four times greater than a window size of about 6 ms. A frequency 508 and a frequency 510 are marked. In some implementations, the frequency 508 and/or 510 is not associated with any acoustic phenomenon of the human ear (e.g., the frequency 508 and/or 510 is not amplified or attenuated by the resonance at 3 kHz). For example, the frequency 508 can be lower than the frequency 504 (e.g., at about 1 kHz or lower). As another example, the frequency 510 can be higher than the frequency 506. The frequency 508 and/or 510 can use a window size different from one or more other frequency sizes. In some implementations, the window size of the frequency 508 and/or 510 is smaller than the window size for the frequency 502. In some implementations, the window size for the frequency 508 and/or 510 is about half as large as the window size for the frequency 502. Having the window size for the frequency 508 and/or 510 be about half as large as the window size for the frequency 502 can provide the advantage of obtaining a higher quality encoding in the portions of the audio signal where resonance effects do not occur or are relatively less significant (e.g., so that the transform is applied to a smaller span of audio signal each time). For example, a window size of about 12 ms is smaller than, and about half as large as, a window size of about 24 ms. In some implementations, the window size for the frequency 508 and/or 510 can be greater than the window size for the frequency 504 and/or 506. In some implementations, the window size for the frequency 508 and/or 510 can be about twice as large as the window size for the frequency 504 and/or 506. Having the window size for the frequency 508 and/or 510 be about twice as large as the window size for the frequency 504 and/or 506 can provide the advantage of obtaining more efficient encoding in the portions of the audio signal where increased temporal response is relatively less significant (e.g., so that the transform is applied to a greater span of audio signal each time). For example, the window size 12 ms is greater than, and about twice as large, as the window size of about 6 ms. The frequencies 504 and 506 can be positioned at opposite sides of the frequency 502. For example, one of the frequencies 504 and 506 can be lower than the frequency 502, and another one of the frequencies 504 and 506 can be lower than the frequency 502. That is, the position can here be defined by frequency. For example, the resonance at the frequency 502 can result in attenuation at both one or more higher frequencies (e.g., at the frequency 506) and at one or more lower frequencies (e.g., at the frequency 504).

An encoder (e.g., the audio encoder 400 in FIG. 4) can be included in a codec. In some implementations, the codec can compute multiples of window sizes. When storing frequencies of different bands, the frequencies of about 1.5 kHz and about 10 kHz can be stored. In some implementations, data can be stored more frequently (e.g., an integer multiple) for these frequencies than a resonance frequency (e.g., about 3 kHz). Storing the data more frequently can provide the advantage of improving the temporal response by the window size being shorter, resulting in the transform being applied to a shorter span of audio signal each time. For example, data for the frequencies of about 1.5 kHz and about 10 kHz can be stored more frequently because their window size is shorter in duration that a window size for a resonance frequency (e.g., about 3 kHz), and so they have outputs for a given time period. For example, if the 3 kHz window size is four times larger than the 1.5 kHz and about 10 kHz window size, one can have four outputs of the latter to one output of the former, each of the latter outputs potentially having a different value than each other. In some implementations, relatively less precision can be used for the frequencies of about 1.5 kHz and/or about 10 kHz. For example, one or two bits can be omitted so that the time data remains and there is a greater extent of quantization. The quantization can be advantageous in reducing the amount of data that is stored, thereby requiring less system resources. In some implementations, relatively more precision can be used for the frequency of about 3 kHz. For example, one or two bits can be added so that there is more data to capture finer amplitude changes in that area. That is, the transformation applied at the resonance frequency (e.g., 3 kHz) can be said to generate a first outcome, and the transformation applied at the attenuated frequency (e.g., 1.5 and/or 10 kHz) can be said to generate a second outcome. The first outcome can be stored less often (e.g., every 24 ms) than the second outcome (e.g., every 6 ms), including, but not limited to, that the second outcome can be stored about four times as often as the first output.

Figure 6:
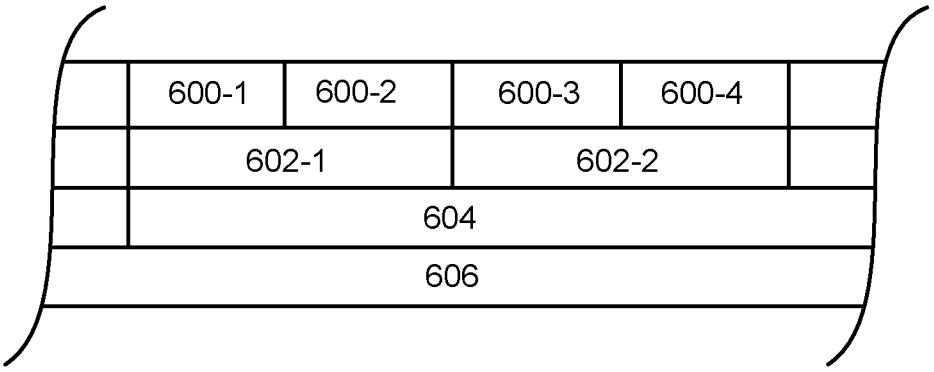
FIG. 6 schematically shows an example of decoding.

FIG. 6 schematically shows an example of decoding. The decoding of these examples can be used with one or more other examples described elsewhere herein. The decoding can be applied to an encoded signal to translate it into another form (e.g., an audio signal). The different sizes of transform implicated by the encoding process can be operated, and summed up at decoding time. In some implementations, the different frequency bands can be represented by different window lengths. That is, in decoding sound one can decode from each of multiple different sizes of transforms. In some implementations, to get one sample out one may have three transforms performed (e.g., referred to as 6 ms-, 12 ms-, and 24 ms-transforms, respectively). They can be summed up and 6 ms of time can be emitted by the decoder. Here, transforms 600-1, 600-2, 600-3, and 600-4 are shown. For example, each of the transforms 600-1 through 600-4 corresponds to applying a transform with a particular window size (e.g., 6 ms) to one or more frequencies. Here, transforms 602-1 and 602-2 are shown. For example, each of the transforms 602-1 and 602-2 corresponds to applying a transform with a particular window size (e.g., 12 ms) to one or more frequencies. Here, transform 604 is shown. For example, the transform 604 corresponds to applying a transform with a particular window size (e.g., 24 ms) to one or more frequencies. A transform 606 schematically represents another application of a transform to the audio signal (e.g., with smaller or greater window size).

The following are examples of decoding. The transforms 600-1, 602-1, and 604 can be performed, of which the transforms 602-1 and 604 can be stored (e.g., in a memory, by the resonance-enhanced decoder 110 in FIG. 1). Then, the transforms 600-1, 602-1, and 604 can be summed up, and used in outputting sound for a portion of time (e.g., 6 ms). Thereafter, the transform 600-2 can be performed. By retrieving the transforms 602-1 and 604 from storage, the transformations 600-2, 602-1, and 604 can be summed up, and used in outputting sound for a portion of time (e.g., 6 ms). Then, the transforms 600-3 and 602-2 can be performed, of which the transform 602-2 can be stored. Then, the transforms 600-3, 602-2, and 604 can be summed up, and used in outputting sound for a portion of time (e.g., 6 ms). Finally, the transform 600-4 can be performed. By retrieving the transforms 602-2 and 604 from storage, the transformations 600-4, 602-2, and 604 can be summed up, and used in outputting sound for a portion of time (e.g., 6 ms).

Figure 7:
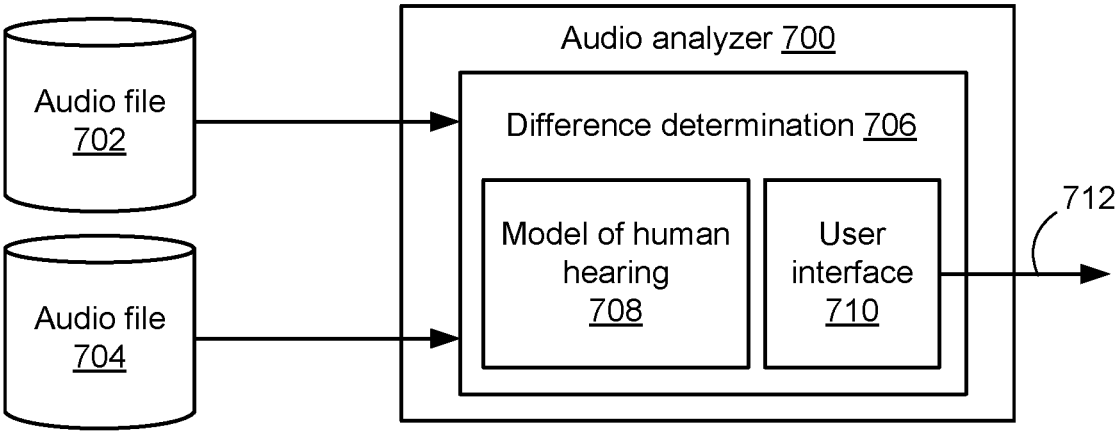
FIG. 7 shows an example of an audio analyzer.

FIG. 7 shows an example of an audio analyzer 700. The audio analyzer 700 can be used with one or more other examples described elsewhere herein. The audio analyzer 700 can be implemented using one or more examples described with reference to FIG. 9. In some implementations, the audio analyzer 700 can be used for determining (e.g., modeling) the difference between audio files. Here, audio files 702 and 704 are shown as being input into the audio analyzer 700. Each of the audio files 702 and 704 can be generated according to the present subject matter. For example, the audio encoder 400 (FIG. 4) can generate the audio files 702 and 704. The audio analyzer 700 includes difference determination circuitry 706. In some implementations, the difference determination circuitry 706 can perform evaluation of the audio files 702 and 704 to determine if they are the same or different, or what the differences are between them. The difference determination circuitry 706 can perform this evaluation as part of speech recognition, blind source separation, directionality determination, security control, identity verification, music selection, and/or fraud detection, to name just a few examples. The difference determination circuitry 706 can apply each of the audio files 702 and 704 to a model 708 of human hearing. In some implementations, the model 708 is a software-based representation (e.g., a psychoacoustic model) of how the human ear works. For example, the model 708 can specify that sound at about the 3 kHz frequency is amplified and subject to energy integration (e.g., temporally smeared), and that sound at about the 1.5 kHz and about 10 kHz frequencies is attenuated and subject to energy differentiation (e.g., transients are enhanced). By the difference determination circuitry 706 applying the audio files 702 and 704 into the model 708 of human hearing, the audio encoder 400 can determine the differences (if any) between the audio files 702 and 704. The difference determination circuitry 706 can include a user interface 710 to output one or more results of evaluating the audio files 702 and 704. In some implementations, the user interface 710 indicates the difference(s), if any, between the user interface 710. The user interface 710 can generate an output 712, such as in form of a binary assessment (e.g., "same" or "not same"), or a quantitative assessment according to a similarity standard (e.g., "95% similar"), to name just a few examples. The output 712 can be generated to a human user or to another component that depends on the evaluation by the audio analyzer 700.

Figure 8:
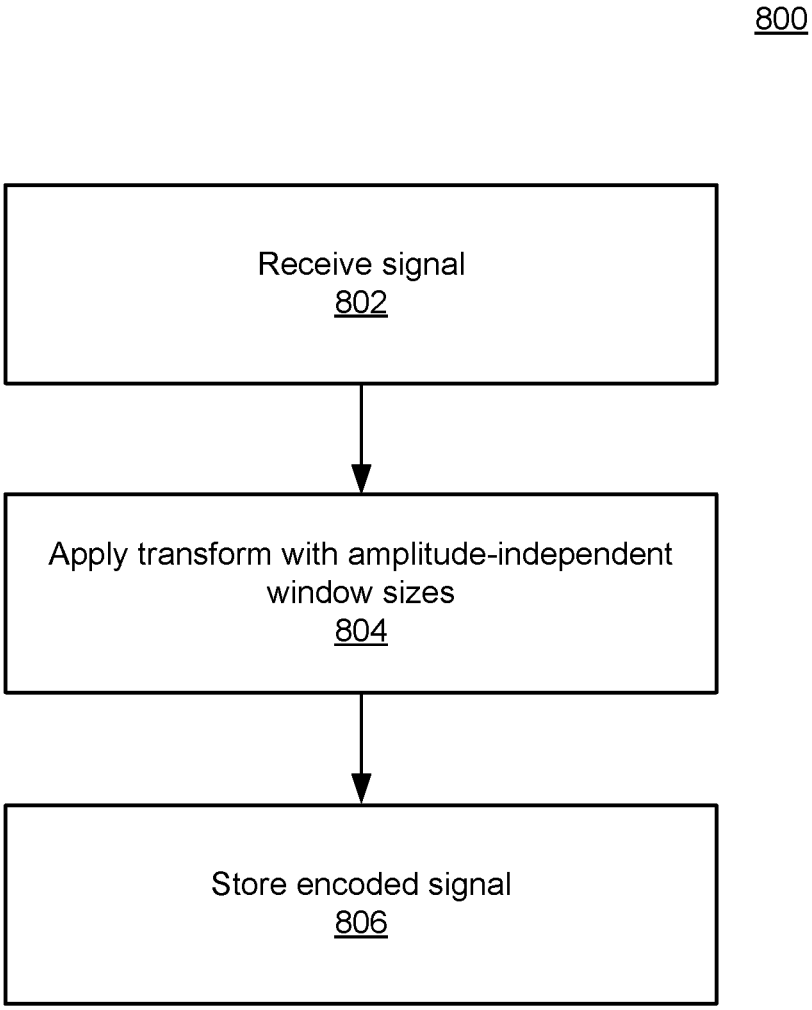
FIG. 8 shows an example of a method.

FIG. 8 shows an example of a method 800. The method 800 can be used with one or more other examples described elsewhere herein. The method 800 can be a computer-implemented method performed by the computing device 900 in FIG. 9. The method 800 can include more or fewer operations than indicated. Two or more of the operations of the method 800 can be performed in a different order unless otherwise indicated.

At 802, a signal can be received. The signal can be an audio signal that corresponds to a flow of energy. For example, the resonance-enhanced encoder 106 can receive a signal from the sound sensors 102 (FIG. 1).

At 804, a transform can be applied to the received signal. In some implementations, the transform uses amplitude-independent window sizes. For example, DCT or FFT can be applied to any of the input signals 302A-C regardless of the amplitude of that signal. Different window sizes can be applied at different frequencies.

At 806, an encoded signal can be stored. For example, the resonance-enhanced encoder 106 (FIG. 1) can store an encoded signal.

Figure 9:
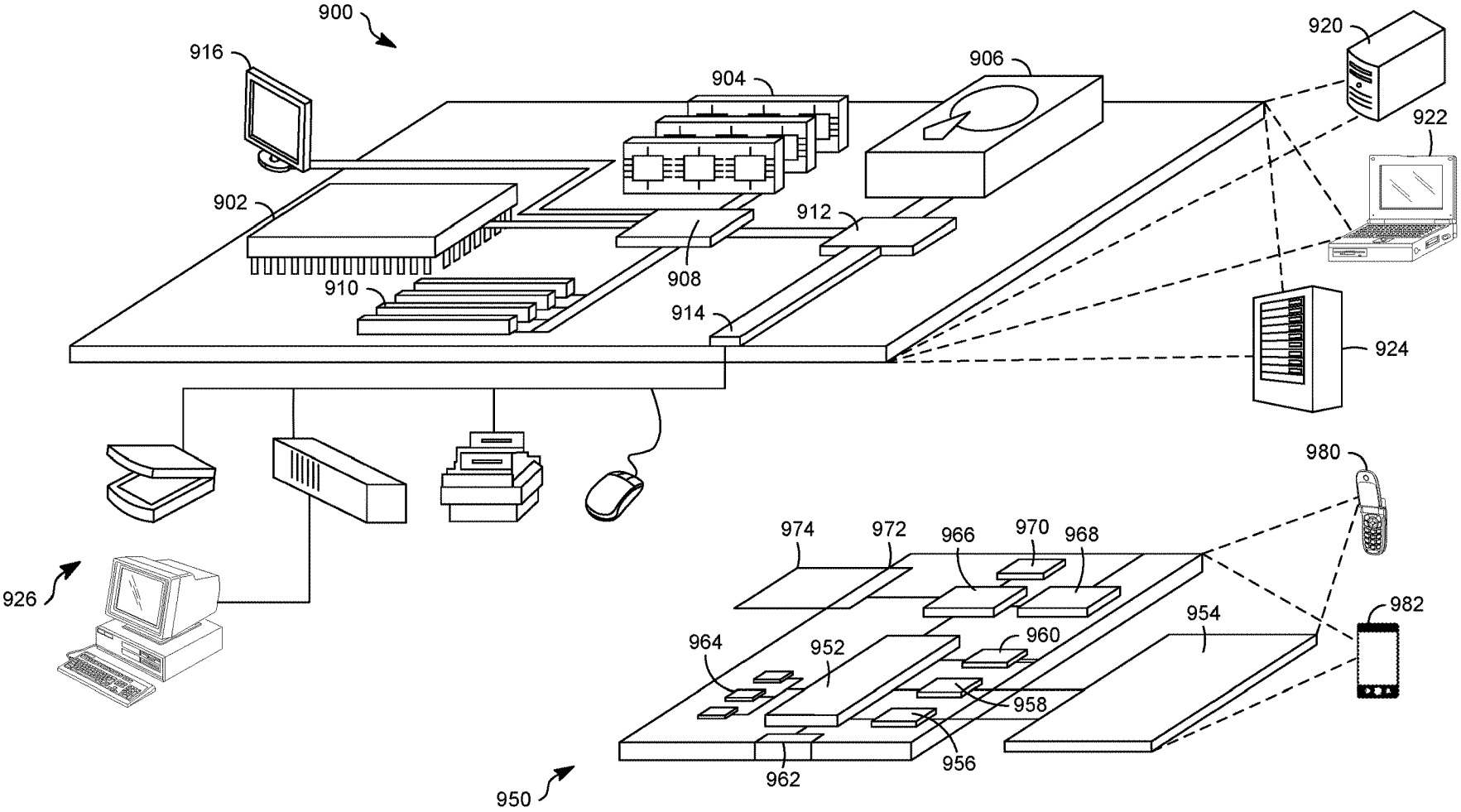
FIG. 9 shows an example of a computer device and a mobile computer device that can be used to implement the techniques described here.

FIG. 9 illustrates an example architecture of a computing device 900 that can be used to implement aspects of the present disclosure, including any of the systems, apparatuses, and/or techniques described herein, or any other systems, apparatuses, and/or techniques that may be utilized in the various possible embodiments.

The computing device illustrated in FIG. 9 can be used to execute the operating system, application programs, and/or software modules (including the software engines) described herein.

The computing device 900 includes, in some embodiments, at least one processing device 902 (e.g., a processor), such as a central processing unit (CPU). A variety of processing devices are available from a variety of manufacturers, for example, Intel or Advanced Micro Devices. In this example, the computing device 900 also includes a system memory 904, and a system bus 914 that couples various system components including expansion ports 910 and the system memory 904 to the processing device 902 via an interface 908. The system bus 914 is one of any number of types of bus structures that can be used, including, but not limited to, a memory bus, or memory controller; a peripheral bus; and a local bus using any of a variety of bus architectures.

Examples of computing devices that can be implemented using the computing device 900 include a desktop computer, a laptop computer, a tablet computer, a mobile computing device (such as a smart phone, a touchpad mobile digital device, or other mobile devices), or other devices configured to process digital instructions.

The system memory 904 includes read only memory and random access memory. A basic input/output system containing the basic routines that act to transfer information within computing device 900, such as during start up, can be stored in the system memory 904.

The computing device 900 also includes a storage device 906 in some embodiments, such as a hard disk drive, for storing digital data. The storage device 906 is connected to the system bus 914 by a secondary storage interface. The storage device 906 and its associated computer readable media provide nonvolatile and non-transitory storage of computer readable instructions (including application programs and program modules), data structures, and other data for the computing device 900.

Although the example environment described herein employs a hard disk drive as a secondary storage device, other types of computer readable storage media are used in other embodiments. Examples of these other types of computer readable storage media include magnetic cassettes, flash memory cards, digital video disks, Bernoulli cartridges, compact disc read only memories, digital versatile disk read only memories, random access memories, or read only memories. Some embodiments include non-transitory media. For example, a computer program product can be tangibly embodied in a non-transitory storage medium. Additionally, such computer readable storage media can include local storage or cloud-based storage.

A number of program modules can be stored in the storage device 906 and/or system memory 904, including an operating system, one or more application programs, other program modules (such as the software engines described herein), and program data. The computing device 900 can utilize any suitable operating system, such as Microsoft Windows™, Google Chrome™ OS, Apple OS, Unix, or Linux and variants and any other operating system suitable for a computing device. Other examples can include Microsoft, Google, or Apple operating systems, or any other suitable operating system used in tablet computing devices.

In some embodiments, a user provides inputs to the computing device 900 through one or more input devices 926. Examples of input devices 926 include a keyboard, mouse, microphone (e.g., for voice and/or other audio input), touch sensor (such as a touchpad or touch sensitive display), and gesture sensor (e.g., for gestural input). In some implementations, the input device(s) 926 provide detection based on presence, proximity, and/or motion. In some implementations, a user may walk into their home, and this may trigger an input into a processing device. For example, the input device(s) 926 may then facilitate an automated experience for the user. Other embodiments include other input devices 926. The input devices can be connected to the processing device 902 through an input/output interface 912 that is coupled to the system bus 914. These input devices 926 can be connected by any number of input/output interfaces, such as a parallel port, serial port, game port, or a universal serial bus. Wireless communication between input devices 926 and the input/output interface 912 is possible as well, and includes infrared, BLUETOOTH® wireless technology, 802.11a/b/g/n, cellular, ultra-wideband (UWB), ZigBee, or other radio frequency communication systems in some possible embodiments, to name just a few examples.

In this example embodiment, a display device 916, such as a monitor, liquid crystal display device, projector, or touch sensitive display device, is also connected to the a bus via an interface 908, such as a video adapter. In addition to the display device 916, the computing device 900 can include various other peripheral devices, such as speakers or a printer.

The computing device 900 can be connected to one or more networks through a network interface. The network interface can provide for wired and/or wireless communication. In some implementations, the network interface can include one or more antennas for transmitting and/or receiving wireless signals. When used in a local area networking environment or a wide area networking environment (such as the Internet), the network interface can include an Ethernet interface. Other possible embodiments use other communication devices. For example, some embodiments of the computing device 900 include a modem for communicating across the network.

The computing device 900 may be implemented as a standard server 920, a rack server system 924 or a laptop computer 922. A computing device 950 includes a processor 952, memory 964, a display 954, a communication interface 966, and a transceiver 968. The processor 952 may communicate with a control interface 958 and display interface 956 coupled to a display 954. The computing device 950 includes an external interface 962. Expansion memory 974 may also be provided and connected to device 950 through expansion interface 972. Computing device 950 may also communicate using audio codec 960.

The computing device 900, 950 can include at least some form of computer readable media. Computer readable media includes any available media that can be accessed by the computing device 900, 950. By way of example, computer readable media include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the computing device 900.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

The computing device illustrated in FIG. 9 is also an example of programmable electronics, which may include one or more such computing devices, and when multiple computing devices are included, such computing devices can be coupled together with a suitable data communication network so as to collectively perform the various functions, methods, or operations disclosed herein.

A number of embodiments have been described. Nevertheless, it will be understood that various modifications may be made without departing from the spirit and scope of the invention.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A computer-implemented method comprising:

receiving a first signal corresponding to a first flow of acoustic energy;

applying a transform to the received first signal including, using a first window during a sampling duration of the transform, the first window having a first amplitude-independent window size based on a first resonance phenomenon at a first frequency and the first amplitude-independent window size is not based on an acoustic energy of the first signal at the first frequency, and using a second window during a sampling duration of the transform, the second window having a second amplitude-independent window size based on a second resonance phenomenon at a second frequency and the second amplitude-independent window size is not based on an acoustic energy of the first signal at the second frequency, the second window improving a temporal response at the second frequency, wherein the second frequency is subject to amplitude reduction due to the first resonance phenomenon associated with the first frequency;

encoding the transformed first signal to generate a first encoded signal; and storing the first encoded signal.

2. The computer-implemented method of claim 1, further comprising mapping the first amplitude-independent window size to the first frequency based on the first frequency being associated with energy integration in human hearing.

3. The computer-implemented method of claim 1, further comprising mapping the second amplitude-independent window size to the second frequency based on the second frequency being associated with energy differentiation in the human hearing.

4. The computer-implemented method of claim 1, wherein the first amplitude-independent window size is used for all frequencies of the received first signal except a frequency band at the second frequency.

5. The computer-implemented method of claim 1, wherein the first amplitude-independent window size is greater than the second amplitude-independent window size.

6. The computer-implemented method of claim 5, wherein the first amplitude-independent window size is greater than the second amplitude-independent window size by an integer multiple.

7. The computer-implemented method of claim 5, wherein the first amplitude-independent window size is four times greater than the second amplitude-independent window size.

8. The computer-implemented method of claim 1, further comprising using a third window in applying the transform to the first received signal, the third window used at a third frequency not associated with the resonance phenomenon, the third window having a third amplitude-independent window size that is different from the first and second amplitude-independent window sizes and is not based on an acoustic energy of the first signal at the third frequency.

9. The computer-implemented method of claim 8, wherein the third amplitude-independent window size is smaller than the first amplitude-independent window size.

10. The computer-implemented method of claim 8, wherein the third amplitude-independent window size is half as large as the first amplitude-independent window size.

11. The computer-implemented method of claim 8, wherein the third amplitude-independent window size is greater than the second amplitude-independent window size.

12. The computer-implemented method of claim 11, wherein the third amplitude-independent window size is twice as large as the second amplitude-independent window size.

13. The computer-implemented method of claim 11, wherein the third amplitude-independent window size is smaller than the first amplitude-independent window size.

14. The computer-implemented method of claim 1, wherein applying the transform using the first window generates a first outcome, wherein applying the transform using the second window generates a second outcome, the method further comprising storing the second outcome more frequently than storing the first outcome.

15. The computer-implemented method of claim 14, further comprising storing the second outcome with less precision than the first outcome.

16. The computer-implemented method of claim 1, further comprising using a third window in applying the transform at a third frequency, the third window improving a temporal response at the third frequency, the third window having a third amplitude-independent window size that is not based on an acoustic energy of the first signal at the third frequency, the third frequency being subject to amplitude reduction due to the resonance phenomenon associated with the first frequency.

17. The computer-implemented method of claim 16, wherein the second and third frequencies are positioned at opposite sides of the first frequency.

18. The computer-implemented method of claim 16, wherein the third amplitude-independent window size is equal to the second amplitude-independent window size.

19. The computer-implemented method of claim 16, wherein the second and third amplitude-independent window sizes are smaller than the first amplitude-independent window size.

20. The computer-implemented method of claim 1, wherein a first audio file comprises the first encoded signal, the method further comprising:

receiving a second signal corresponding to a second flow of acoustic energy;

applying the transform to the received second signal using at least the first window at the first frequency and the second window at the second frequency;

storing a second encoded signal, the second encoded signal based on applying the transform to the received second signal, wherein a second audio file comprises the second encoded signal; and determining a difference between the first and second audio files.

21. The computer-implemented method of claim 20, wherein determining the difference comprises playing the first and second audio files into a model of human hearing, the model including the first resonance phenomenon and the second resonance phenomenon.

22. A computer program product tangibly embodied in a non-transitory storage medium, the computer program product including instructions that when executed by a processor cause the processor to perform operations, the operations comprising:

receiving a first signal corresponding to a first flow of acoustic energy;

applying a transform to the received first signal including, using a first window during a sampling duration of the transform, the first window having a first amplitude-independent window size based on a first resonance phenomenon at a first frequency and the first amplitude-independent window size is not based on an acoustic energy of the first signal at the first frequency, and using a second window during the sampling duration of the transform, the second window having a second amplitude-independent window size based on a second resonance phenomenon at a second frequency and the second amplitude-independent window size is not based on an acoustic energy of the first signal at the second frequency, the second window improving a temporal response at the second frequency, wherein the second frequency is subject to amplitude reduction due to the first resonance phenomenon associated with the first frequency;

encoding the transformed first signal to generate a first encoded signal; and storing the first encoded signal.

23. The computer program product of claim 22, wherein performing the operations according to the instructions causes an increase in amplitude sensitivity at the first frequency.

24. The computer program product of claim 23, wherein the increase in amplitude sensitivity is due to the first amplitude-independent window size being larger than the second amplitude-independent window size.

25. The computer program product of claim 22, wherein performing the operations according to the instructions causes an increase in temporal sensitivity at the second frequency.

26. The computer program product of claim 25, wherein the increase in temporal sensitivity is due to the second amplitude-independent window size being smaller than the first amplitude-independent window size.

27. The computer-implemented method of claim 1, wherein improving the temporal response includes increasing a temporal resolution of the first encoded signal by including less audio content when applying the transform.

* * * * *